US008245863B2

(12) United States Patent
Pearlstein

(10) Patent No.: US 8,245,863 B2
(45) Date of Patent: Aug. 21, 2012

(54) EXPLOSION RESISTANT GAS TANK DESIGN

(76) Inventor: Dennis Pearlstein, Draper, UT (US)

( * ) Notice: Subject to any disclaimer, the term of this patent is extended or adjusted under 35 U.S.C. 154(b) by 374 days.

(21) Appl. No.: 12/357,188

(22) Filed: Jan. 21, 2009

(65) Prior Publication Data

US 2009/0242556 A1 Oct. 1, 2009

Related U.S. Application Data

(60) Provisional application No. 61/022,169, filed on Jan. 18, 2008.

(51) Int. Cl.
*B65D 90/40* (2006.01)

(52) U.S. Cl. ..... 220/88.1

(58) Field of Classification Search ..... 220/88.1, 220/721, 567.2, 581, 585–591; 206/0.6, 206/0.7; 148/325; 428/605, 222, 34.1, 457
See application file for complete search history.

(56) References Cited

U.S. PATENT DOCUMENTS 4,514,458 A * 4/1985 Thorn et al. ..... 428/222
4,615,455 A 10/1986 Tansill
4,927,045 A * 5/1990 Lichka ..... 220/88.1
5,536,454 A * 7/1996 Fujii et al. ..... 261/97
5,979,481 A 11/1999 Ayresman

* cited by examiner

*Primary Examiner* — J. Gregory Pickett
*Assistant Examiner* — Andrew Perreault
(74) *Attorney, Agent, or Firm* — Holland & Hart LLP

(57) ABSTRACT

A gasoline storage system includes a storage area and a porous, non gasoline reactive, and non-particulate generating material disposed within the storage area.

4 Claims, 5 Drawing Sheets

EXPLOSION RESISTANT GAS TANK DESIGN

RELATED APPLICATION

This application claims the benefit under 35 U.S.C. §119 (e) of U.S. Provisional Patent Application No. 61/022,169 filed Jan. 18, 2008, which is titled "Explosion Resistant Gas Tank Design". The above-mentioned application is incorporated herein by reference in its entirety.

TECHNICAL FIELD

The present system and method relate to gasoline storage systems. More specifically, the present system and method relate to simple and economical gas tank storage systems configured to reduce the likelihood of explosions caused by a compromise of the gasoline storage system.

BACKGROUND

Conventional containers for storing fuel and the like have been known for many years. Typically, these fuel containers have a closeable mouth for permitting the ingress of fuel, or whatever liquid, into the container, and for permitting subsequent egress of the fuel, or other liquid, from the container. The mouth is closeable by means of a cap that might be either a one piece cap or a two piece cap. Commonly, two piece caps include a collar that is also used to retain the removable and replaceable spout in place on the fuel can for dispensing fuel. In order to pour out the liquid from the container, the cap is merely removed from the mouth, and the container is tilted until the mouth is lower than the level of the liquid. Commonly, an air relief opening having its own selectively removable and replaceable cap permits ready airflow into the interior of the container. New environmental regulations are restricting these containers to only one opening.

Containers for storing liquids for transfer are used in many different applications such as for gasoline or other liquid fuels. The containers are filled up with liquid, such as gas, until they are required for use, at which time the liquid must be transferred. When the transfer for use is required, often a pouring nozzle is attached to the opening and the liquid is poured into a receiving receptacle using a funnel seated at the receptacle opening. Sometimes, due to the urgency or simply the lack of materials on hand, no funnel is available to the user, and the liquid is prone to spillage outside of the receiving receptacle. Even with a funnel, the pouring process can be difficult if the funnel is not properly seated. As well, the container, while filled with fluid, has to be lifted by the person pouring. Pouring liquids from these transfer/storage containers can be both awkward and strenuous.

Furthermore, as gasoline is removed from a gasoline container for various purposes, the remaining gasoline expands and fumes are generated to occupy the empty space remaining in the container. These fumes are highly combustible. Numerous people die each year and multiple homes are burned each year due to explosions caused by the ignition of the highly combustible fumes generated in a partially empty gasoline container.

Portable fuel containers have been around for a long time and are necessary for transporting and transferring fuel to numerous vehicles and devices such as lawnmowers, snowmobiles, boats, chainsaws, weed trimmers etc. and transferring the fuel between the portable fuel container and the gas tank of these items is typically done by lifting the container and pouring the fuel into the gas tank.

There have been many attempts at providing a safer method of storing and transporting gasoline via reducing the amount of commingled combustible fumes present in a gasoline container. However, traditional methods have been very cost prohibitive. For example, U.S. Pat. Nos. 4,615,455 and 5,979,481 each independently teach apparatuses and methods for the reduction of vapors in a fuel tank in order to reduce the likelihood of an explosion resulting in the fuel tank. However, as illustrated in the '455 patent and the '481 patent, each design includes a compressible filler material contained in the internal space of the tank that is systematically compressed by a bladder or other expandable member to both release the fuel and fill the remaining space. However, both prior art systems require such things as pressure transducers, inert gas regulators, gas compressors, and other complex systems that are both bulky and cost prohibitive. Consequently a need exists for a cost effective system for reducing the likelihood of an explosion occurring with a fuel container.

SUMMARY

In one of many possible embodiments, the present system and method provides for a cost effective explosion resistant fuel container that includes an outer member defining an inner volume, wherein the inner volume of the fuel container is filled with a porous, gas-inert material having a pore size sufficiently large to allow fuel to pass there through.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

Gasoline container systems are provided herein for use in several applications, including portable personal use containers, automobile fuel supply containers, underground fuel containers, and/or gasoline transport containers. By utilizing the present exemplary systems and methods, explosions due to gasoline fumes can be greatly reduced and in many instances eliminated. Particularly, the present exemplary system and method provide a cost effective approach to reducing the formation of highly combustible fuel vapor in a fuel container by reducing the effective volume of the container subject to vapor formation and by simultaneously limiting the area of the fuel oxygen interface using a porous vapor reducing material.

In the following description, for purposes of explanation, numerous specific details are set forth in order to provide a thorough understanding of the present method and apparatus for the formation of an explosion resistant fuel container. It will be apparent, however, to one skilled in the art that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Fuel Storage System

Figure 1:
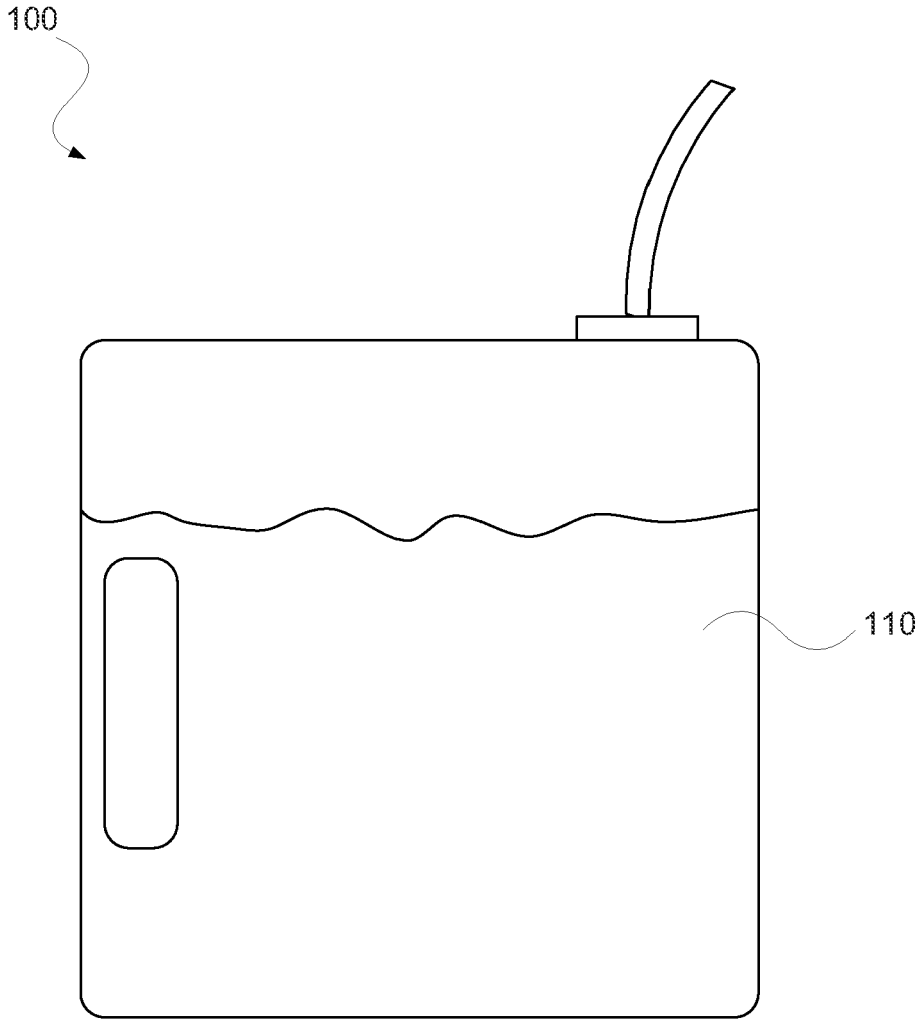
Fig. 1 Prior Art
FIG. 1 is a side perspective view of a traditional gasoline container, according to one exemplary embodiment.

FIG. 1 is a perspective view of a traditional gasoline container (100), according to one exemplary embodiment. Traditionally, gasoline (110) is placed into the illustrated container and incrementally used as needs arise for the filling of ATV's, lawnmowers, weed-eaters, automobiles, and the like. While the present exemplary system and method is described in the context of a portable gasoline container, the systems and methods may be applied to any fuel container to reduce the likelihood of explosion and injury including, but in no way limited to, portable gasoline containers, automobile fuel tanks, fill station underground fuel tanks, and the like.

Continuing with FIG. 1, as mentioned previously, the incremental removal of liquid gasoline from the containers also incrementally increases the volume of flammable gasoline vapors present in the container (100). That is, as fuel (110) is removed from the traditional gasoline container, the volume available for the formation of highly combustible fuel vapors increases. The gasoline vapors traditionally present in these types of containers (100) are often the cause of explosion when ignited. In fact, explosions from automobile accidents are often the result of ignition of gasoline fumes rather than an ignition of the liquid fuel (110) associated with the automobile. It has been shown that when fuel vapors escape a fuel container (100) through a tear or crack and are then ignited, the consumption of the fuel vapors by the flame actually draws additional fuel vapors out, creating an escalation of flame, finally resulting in explosion. The effective reduction or elimination of explosive gasoline fumes would necessarily extend the time an automobile operator would have to escape from an accident before life threatening fire began to spread. Furthermore, the addition of a mechanism for regulating or greatly reducing the flow of fuel vapors from the fuel container through a hole, crack, or other barrier breech reduces the likelihood of flame escalation and explosion.

Figure 2:
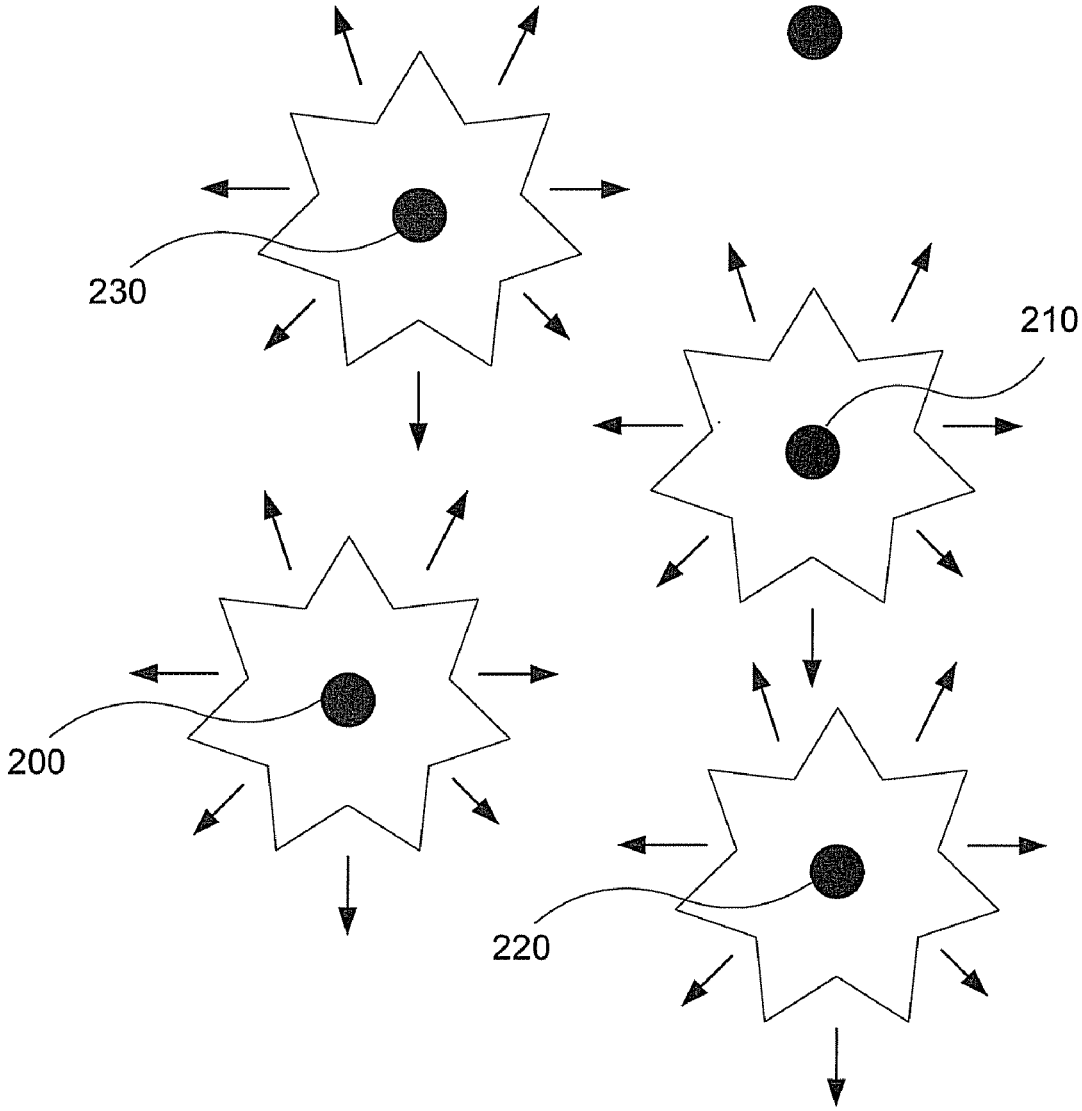
FIG. 2 is a simple diagram illustrating the propagation of a fuel vapor chain reaction explosion, according to one exemplary embodiment.

According to one exemplary embodiment, the gasoline fumes contained in a gasoline container are volatile due to the potential for a flammable chain reaction that occurs when adjacent gasoline fumes combust. Specifically, adjacent gasoline particles in vapor form are prone to igniting in a chain reaction. FIG. 2 illustrates the generation of a chain reaction explosion of adjacent fuel fume particles, according to one exemplary embodiment. As illustrated, when a first fuel particle (200) is ignited, it gives off energy in three dimensions. The resulting release of energy then ignites adjacent particles (210, 220, 230), causing them to similarly release energy in three dimensions. The rapid propagation of flame from one particle to another, and the subsequent release of energy in all directions results in explosion. This explosion often results in injury or death. As this chain reaction continues, an extraordinary amount of energy is releases until fuel vapor particles are no longer available to propagate the energy release, or a physical barrier prevents the spread of the chain reaction.

According to one exemplary embodiment, the present exemplary system and method prevents combustible explosion of adjacent fuel vapors contained within a fuel storage volume by a process of filling the inner volume of the gasoline storage volume with a porous, non-gasoline reactive, and non-particulate generating material. According to one exemplary embodiment, the porous, non-particulate generating material is configured to allow for the controlled release of the liquid fuel without compression of the material by an outside force, while providing an obstacle for fuel vapors to escape when a breech of the fuel container exterior occurs. The non-gasoline reactive nature of the material allows the presence of the porous material in a fuel container without fear of the material decomposing to become ineffective or to breakdown to particulates that may then enter and damage a fuel system.

According to one exemplary embodiment, the non-gasoline reactive, and non-particulate generating material may include, but is in no way limited to a porous metal matrix such as stainless steel wool, aluminum shaving matrix, and the like. Additionally, a fire-resistant plastic, ceramic, or composite containing a plurality of open celled pores may be incorporated in the present exemplary system and method including, but in no way limited to, a plastic having greater than or equal to 65 wt. % high density polyethylene and a sufficient amount of intumescence additive material to impart fire resistant properties, any plastic including a microencapsulation of flame retardants wherein the outer shell of the microscopic capsules is made of non-fusible, flame-resistant melamine resin wherein the flame retardants remain enclosed in the capsules and are only released in the event of fire, any plastic encapsulating a fire retardant such as nitrogen, carbon dioxide and compounds designed to produce extinguishing gases in reaction to heat, plastics containing halogenated flame retardants, fiber-reinforced polymers made of melt-spun melamine fibers, and/or high tenacity melamine foams that begin to slowly decompose at temperatures above 360° C.

Figure 3:
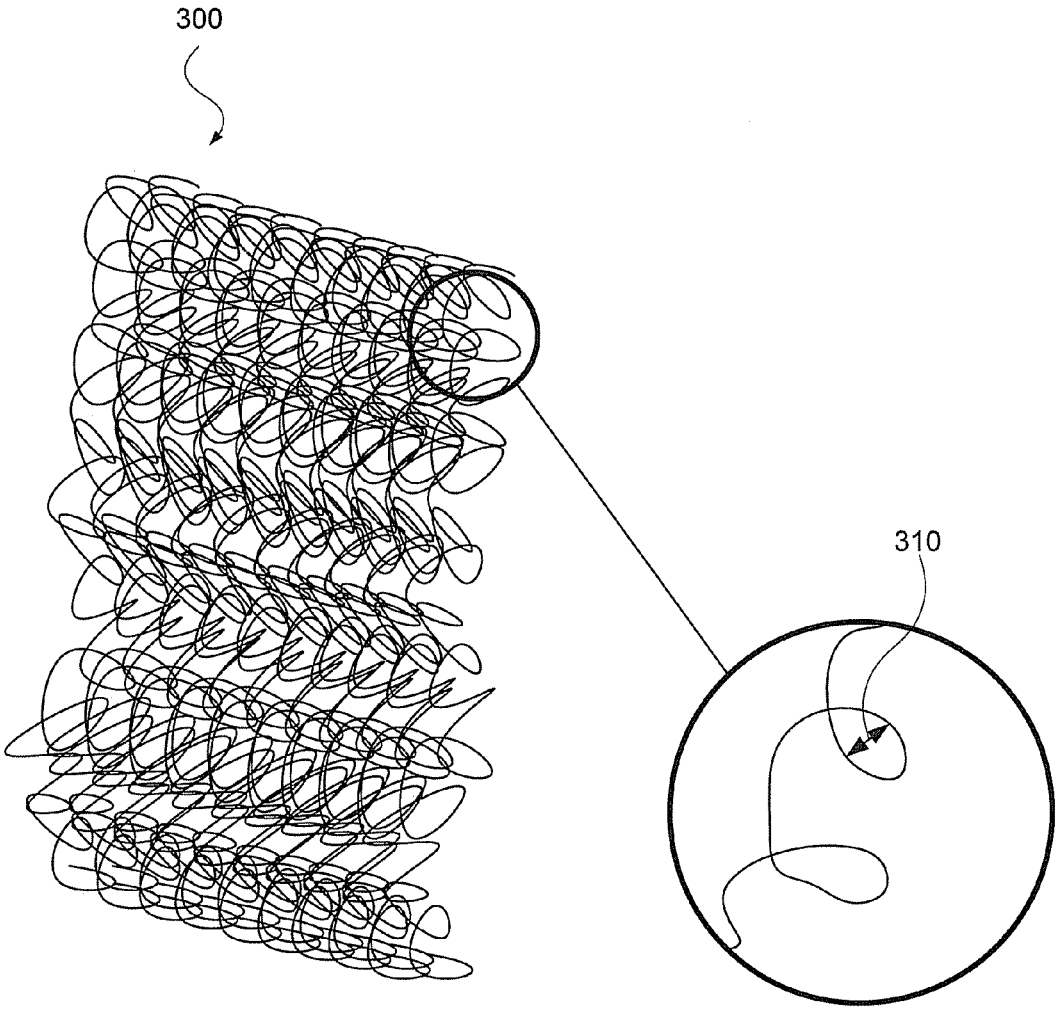
FIG. 3 is a side perspective view of a steel wool based porous volume filling material, according to one exemplary embodiment.

For ease of description, the present exemplary system and method will be described in the context of a higher grade steel wool volume filling material occupying the inner volume of the gas container. As illustrated in FIG. 3 a stainless steel sponge like liner similar to a coarse steel wool (300) may be used to occupy the volume of a fuel container. According to one exemplary embodiment, the coarse steel wool (300) is made from alloy type AISI 434 stainless steel. According to this exemplary embodiment, the coarse steel wool (300) can withstand temperatures in excess of 700° C. and peak temperatures of 800° C. for up to 10 minutes without damage or degradation. Consequently, this exemplary steel wool will reduce the amount of available fuel vapor for some time, allowing any persons near the fuel container to escape injury. According to one exemplary embodiment, the AISI 434 steel wool includes a chemical make up of C (Carbon) 0.12% max; Si (Silicon) 1.0% max; Mn (Manganese) 1.0% max; S (Sulfur) 0.03% max; P (Phosphorous) 0.04% max; Cr (Chromium) 16.0-18.0% max; Mo (Molybdenum) 1.25% max; and Fe (Iron) remainder. According to one exemplary embodiment, the exemplary steel wool includes an average orifice diameter (310) greater than 0.005 inch so that the liquid fuel is not held in the volume filling material due to capillary action when it is desired to be poured or otherwise removed for use.

According to one exemplary embodiment, when weight sensitive situations are presented, the above-mentioned exemplary stainless steel filler material may be replaced by a lightweight plastic mesh having the same minimum orifice dimensions.

Figure 4:
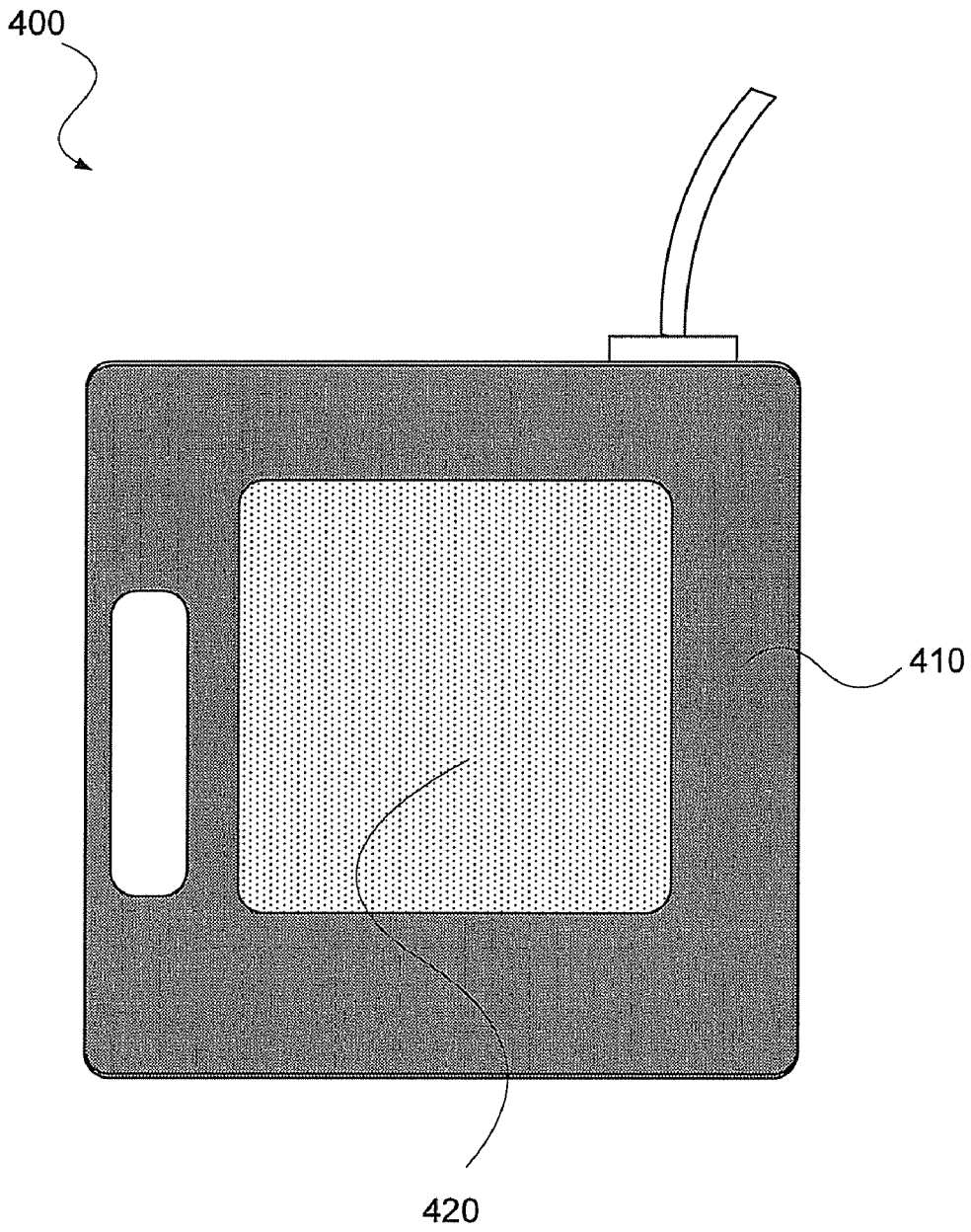
FIG. 4 is a side cross-sectional view of a fuel container containing a porous vapor reducing material, according to one exemplary embodiment.

According to another exemplary embodiment, illustrated in FIG. 4, the density of the porous volume filling material, such as steel wool, may vary throughout the volume. Specifically, as illustrated in FIG. 4, an exemplary fuel container (400) may include 2 layers of porous volume filling material including a dense porous volume filling material (410) and a more porous volume filling material (420). According to this exemplary embodiment, the dense porous volume filling material (410) may be located on the outside of the volume being filled such that if the surface of the exemplary fuel container (400) is compromised due to rupture or accident, the immediate internal area exposed to flame and/or heat will be the dense porous volume filling material (410) configured to reduce the flow of fuel vapor to prevent explosion. Conversely, a majority of the internal volume of the exemplary fuel container (400) is filled with more porous volume filling material (420) which provides support for the dense porous volume filling material (410) while allowing for a more free flow of liquid fuel when needed for pouring or pumping to a fuel system.

According to various exemplary embodiments, the above-mentioned porous volume filling materials may be added to fuel containers during any number of manufacturing points of time. Specifically, the porous volume filling material(s) may be added to any number of fuel containers during manufacture of the fuel container. Specifically, as a fuel container is manufactured, steel wool or another of the above-mentioned porous volume filling materials may be added to the internal volume of the fuel container. According to one exemplary embodiment, the porous volume filling material is adhered to the internal surface of the fuel container. Alternatively, sufficient porous volume filling material may be inserted into the internal volume of the fuel container that no adhesive or adhering method is needed.

Alternatively, the above-mentioned volume filling porous material may be added to a fuel container after manufacture by a consumer. Specifically, a sufficient amount of volume filing porous material may be inserted into an existing fuel container to reduce the likelihood of a chain reaction explosion of fuel vapor, as explained herein.

Figure 5:
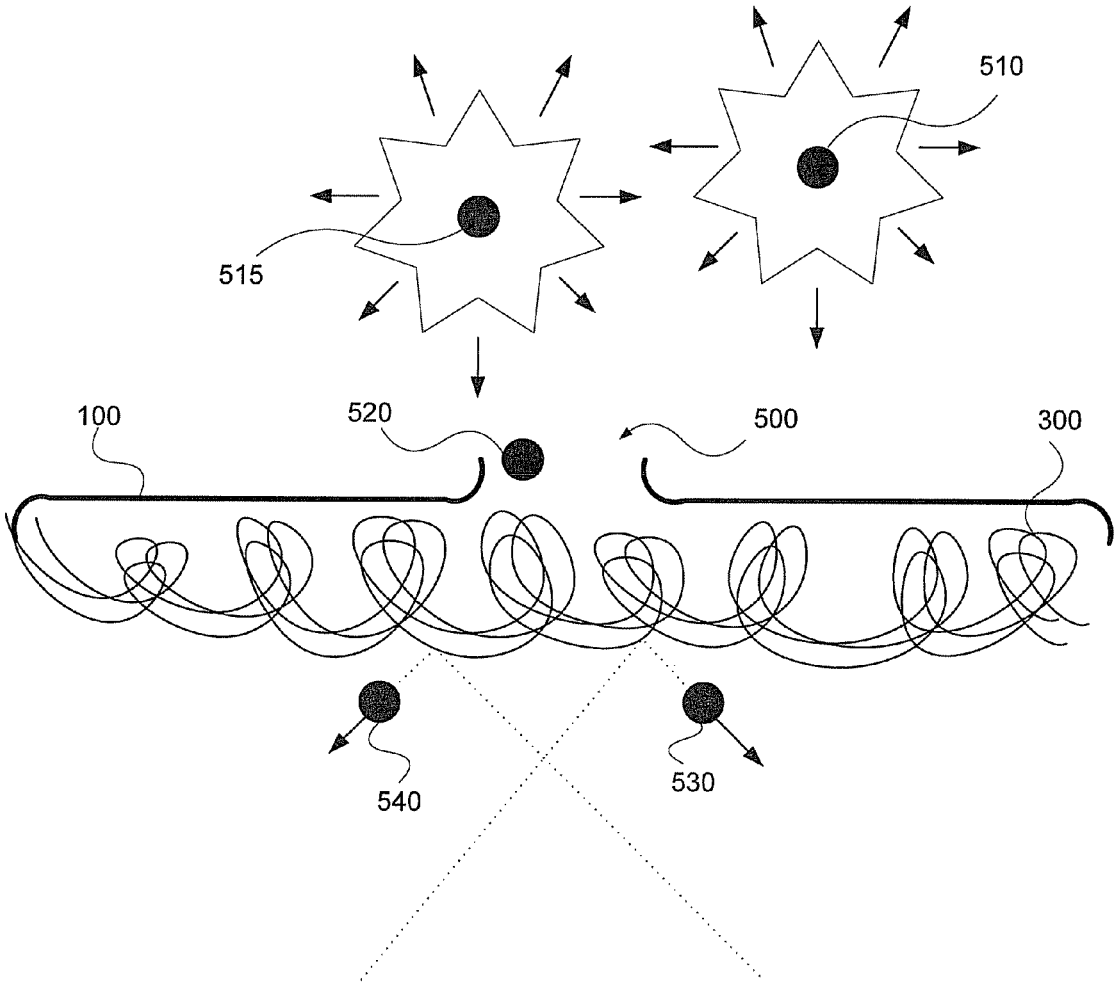
FIG. 5 is a diagram illustrating the prevention of fuel vapor explosion with a porous volume filling material, according to one exemplary embodiment.

FIG. 5 is a graphical illustration of how the inclusion of a porous volume filling material will reduce the likelihood of a fuel vapor explosion. As illustrated in FIG. 5, a fuel container (100) may, due to an accident or wear, have an orifice (500) or other opening compromising the surface of the fuel container such that there is at least vapor access to the internal volume of the fuel container. According to this exemplary embodiment, as liquid fuel contained within the fuel container is vaporized, it will expand and the fuel vapor molecules will eventually escape through the orifice (500).

Once the molecules have exited the fuel container (100) through the orifice (500), they may come into contact with flame or extreme heat causing combustion of those particles (510, 515). As mentioned above, the combustion of the fuel particles causes a release of energy in three dimensions. This free energy may then ignite other free fuel molecules (520).

However, according to the present exemplary embodiment, the porous filler material (300) prevents close adjacent contact of large volumes of combustible particles while restricting the rapid diffusion of fuel particles out the orifice (500). As illustrated, as combustion occurs outside the orifice (500), further internal particles (530, 540) are drawn toward the orifice where they are likely to combust. However, as the fuel molecules encounter the porous filler material, their path is restricted and often redirected by the porous filler material (300). Due to the separation and limited release of fuel vapor created by the inclusion of the porous filler material (300), chain reaction combustion of the vapors or airborne gasoline particles (530, 540) is prevented.

Experimental Results

According to one exemplary embodiment, a number of small fuel containers and gas cans, both metal and plastic were filled with various levels of gasoline. Specifically, according to one experimental method, the various fuel containers were filled with the present exemplary porous filler material and then filled full, ¾ full, ½ full, ⅓ full, and empty in temperatures of over 100 degrees. A gasoline soaked rag was then inserted into an orifice of the fuel containers and lit in an attempt to generate a chain reaction initiated explosion. In each instance, the fuel contained in the gasoline containers would burn, but, unexpectedly, there was no explosion or chain-reaction burning of fumes contained within the containers.

Continuing with the experiment, after allowing the rag to burn for some time, the gasoline containers were then shot with a rifle in an attempt to generate a chain-reaction explosion. However, even after catastrophic failure of the container, no chain-reaction explosion was generated.

In conclusion, any existing gasoline container including, but not limited to, a handheld container, an automobile fuel tank, an underground fuel storage tank, a gasoline transport vehicle, and the like may be filled, either during production or after purchase with a volume occupying porous material as explained above. Testing indicates that the inclusion of the present exemplary porous filler material may add between approximately 2 and 15% weight while taking up less than 5% of the liquid volume of the gasoline container, while preventing or greatly reducing the likelihood of a chain reaction fuel vapor explosion. Particularly, the present exemplary system and method provide advantage over prior art explosion resistant systems in that there is no need for additional system components such as compressors and/or expanding bladders or other members. Rather, the regular flow and use of the liquid fuel is unaffected, while providing explosion resistance at a relatively inexpensive cost.

The preceding description has been presented only to illustrate and describe embodiments of the present exemplary system and method. It is not intended to be exhaustive or to limit the present system and method to any precise form disclosed. Many modifications and variations are possible in light of the above teaching. It is intended that the scope of the present system and method be defined by the following claims.

What is claimed is:

1. A gasoline storage system comprising;

a gasoline storage area; and a porous volume filling material disposed within said storage area, said porous volume filling material including a non gasoline reactive and non-particulate generating material;

wherein said porous volume filling material has an average orifice size of greater than 0.005 inches;

wherein said storage system comprises one of a portable gasoline container, an underground gasoline tank, a vehicle fuel tank, or a gasoline transport container, and wherein said porous volume filling material adds between 2 and 15% weight to said gasoline storage system while taking up less than 5% of the liquid volume of said storage area; and wherein said porous volume filling material is formed entirely of a polymer;

wherein said storage area comprises:

a center volume;

a surrounding volume encapsulating said center volume and extending to an edge of said storage area;

wherein a first porous volume filling material is disposed in said center volume;

wherein a second porous volume filling material is disposed in said surrounding volume; and wherein said second porous volume filling material is more dense than said first porous volume filling material.

2. A gasoline storage system comprising;

a storage area including a center volume and a surrounding volume encapsulating said center volume and extending to an edge of said storage area;

a first porous volume filling material disposed in said center volume;

a second porous volume filling material disposed in said surrounding volume;

said first porous volume filling material including a non gasoline reactive and non-particulate generating material;

said second porous volume filling material including a non gasoline reactive and non-particulate generating material;

wherein said first and second porous volume filling materials each has an average orifice size of greater than 0.005 inches;

wherein said storage system comprises one of a portable gasoline container, an underground gasoline tank, a vehicle fuel tank, or a gasoline transport container;

wherein a combination of said first and second porous volume filling materials adds between 2 and 15% weight to said gasoline storage system while taking up less than 5% of the liquid volume of said storage area;

wherein said second porous volume filling material is more dense than said first porous volume filling material.

3. The gasoline storage system of claim 2, wherein said porous volume filling material is added to said storage area after said gasoline storage system is manufactured.

4. The gasoline storage system of claim 3, wherein said first and second porous volume filling materials disposed within said storage area comprises one of a coarse stainless steel sponges made from alloy type AISI 434 stainless steel or a plastic mesh.

* * * * *